United States Patent [19]

Vallet

[11] Patent Number: 4,791,986

[45] Date of Patent: Dec. 20, 1988

[54] TUBING HANGER

[76] Inventor: Aldon J. Vallet, 10512a-17 Avenue,, Edmonton, Alberta, Canada, T6J 5B5

[21] Appl. No.: 61,863

[22] Filed: Jun. 15, 1987

[30] Foreign Application Priority Data

Sep. 9, 1986 [CA] Canada ..... 517773

[51] Int. Cl.[4] ..... E21B 33/04

[52] U.S. Cl. ..... 166/85; 166/96; 166/379; 166/382

[58] Field of Search ..... 166/82, 85, 86, 88, 166/96, 379, 382, 387

[56] References Cited

U.S. PATENT DOCUMENTS

| | | | |
|---|---|---|---|
| 2,241,333 | 5/1941 | Smith | 255/1.8 |
| 2,638,169 | 5/1953 | Crain | 166/85 |
| 3,011,552 | 12/1961 | Rhodes et al. | 166/85 |
| 3,095,627 | 7/1963 | Johnson | 166/82 |
| 4,278,278 | 7/1981 | Chambless et al. | 166/85 |
| 4,344,651 | 8/1982 | Longacre, et al. | 166/387 |
| 4,410,040 | 10/1983 | Longacre et al. | 166/118 |
| 4,512,410 | 4/1985 | Forester | 166/387 |
| 4,552,213 | 11/1985 | Boyd et al. | 166/82 |
| 4,646,827 | 3/1987 | Cobb | 166/88 |

FOREIGN PATENT DOCUMENTS

| | | |
|---|---|---|
| 577420 | 6/1959 | Canada . |
| 621839 | 6/1961 | Canada . |
| 750202 | 1/1967 | Canada . |
| 794160 | 9/1968 | Canada . |
| 856565 | 11/1970 | Canada . |
| 904173 | 7/1972 | Canada . |
| 1092509 | 10/1978 | Canada . |
| 1048927 | 2/1979 | Canada . |
| 1064821 | 10/1979 | Canada . |

*Primary Examiner*—Jerome W. Massie IV
*Assistant Examiner*—Terry L. Melius
*Attorney, Agent, or Firm*—Stevens, Davis, Miller & Mosher

[57] ABSTRACT

There is disclosed an apparatus including a tubing spool and tubing hanger which overcomes problems associated with servicing of oil and gas wells under pressure. In the invention, a tubing hanger can move through a tubing spool and be seated and sealed from the outside the tubing spool. The tubing hanger includes a flexible packing element with means for engaging and expanding the element to the tubing hanger in the tubing spool and a plurality of locking means adapted to secure the dognut in relation to the tubing spool.

3 Claims, 7 Drawing Sheets

TUBING HANGER

FIELDS OF THE INVENTION

This invention relates to a tubing hanger or dognut and a tubing spool used in servicing oil or gas wells. The apparatus can be used to hold a downhole packer in the packed position or to compensate for a change in length of the tubing.

BACKGROUND OF THE INVENTION

When equipping an oil or gas well or an injection well for production or other use, it is often required to use a downhole packer which is connected to the wellhead by tubing which is held under tension. The tension is required to hold the packer in the packed position, or to compensate for a change in length of the tubing if hot liquid or gases move up or down the tubing. Often, it is required to carry out the installation of this equipment while the well is under pressure from the geological zone of interest.

In a conventional tubing hanger system, once the downhole packer is in place, tension is then put on the tubing by pulling it. To install the tubing hanger on the well, the tubing string is stretched out of the tubing and held by slips. Once the tubing hanger has been installed, the slips are released and the tubing hanger is lowered into place in the conical section of the tubing spool and secured with dog screws. The packing ring is then tightened by turning in the packing bolts. The packing then seals the cavity in the hanger and the casing from anything above the tubing hanger.

When using a conventional tubing spool and tubing hanger system in a well under pressure, the packer and tubing are installed by an operation called "snubbing" where items are pushed into the well against the well pressure with suitable above ground equipment. In order to keep the pressure confined, blow out preventers are utilized. Once the tubing hanger has been installed on the tubing in the same manner as set out above, it is lowered through a first upper blow out preventer which has been opened to allow its passage into the annular space between the blow out preventers. During this operation, the second or lower blow out preventer is sealing the pressure in the well as the tubing slips through it. Once the blow out preventer is closed, the lower blow out preventer is opened to allow the passage of the dognut which is then seated in the conical part of the tubing spool. In order to set the packing, it is then necessary to remove the blow out preventer stack. There is always a problem at this stage as the pressure may not be sealed by the loose packing or primary packing. A second problem associated with the conventional tubing hanger system is that the stretch required to get the tubing through the blow out preventer stack is quite long and in shallow wells this becomes a critical factor in having the proper tension in the tubing with the tubing hanger in its final position in the hanger.

SUMMARY OF THE INVENTION

The present invention provides a tubing spool-tubing hanger dognut system wherein the tubing hanger can move through the tubing spool and be seated and sealed from outside the tubing spool. This system overcomes the problem associated with the conventional tubing spool-hanger system since the tubing hanger is put in place on the tubing and the packer latched in place in the well before the tensioning of the tubing takes place.

According to a broad aspect, the invention relates to a combined tubing spool and hanger assembly for use in servicing oil and gas wells. The assembly comprises a tubing spool for connection to the upper end of the well casing, the spool including an internal annular portion of reduced diameter with respect to the remainder of the internal surface of the spool and sized to allow the tubing hanger to pass therethrough. Means are provided for locating the tubing hanger in the reduced diameter portion of the spool and means are also provided for releasably securing the tubing hanger in the spool and which comprises a plurality of circumferentially spaced recesses in the side wall of the hanger and a corresponding plurality of locking pins positioned in the spool and being engageable with the recesses to prevent movement of the hanger in the spool. An annular, resilient packing element is provided on the hanger and, when compressed, engages and seals against the annular portion of reduced diameter in the spool. Means are provided on the hanger for expanding the resilient packing element into sealing engagement with the spool and means are also located in the wall of the spool to actuate the expanding means. The hanger locating means, releasable securing means and the expander actuating means are all operable from outside of the tubing and hanger assembly.

Once the tubing hanger has been installed on the tubing in the usual manner, it is lowered through the tubing spool. Once the packer is latched and packed off in the well casing, the tubing hanger and tubing string will be pulled upward and the tubing thus stretched. Locking pins located in the tubing spool will then be turned in so as to engage the locking recesses of the tubing hanger, thus locking it in place. Dog pins also located in the tubing spool are then turned in to expand the packing element and seal the spaces below and above the tubing hanger.

DESCRIPTION OF THE PREFERRED EMBODIMENT

Figure 1:
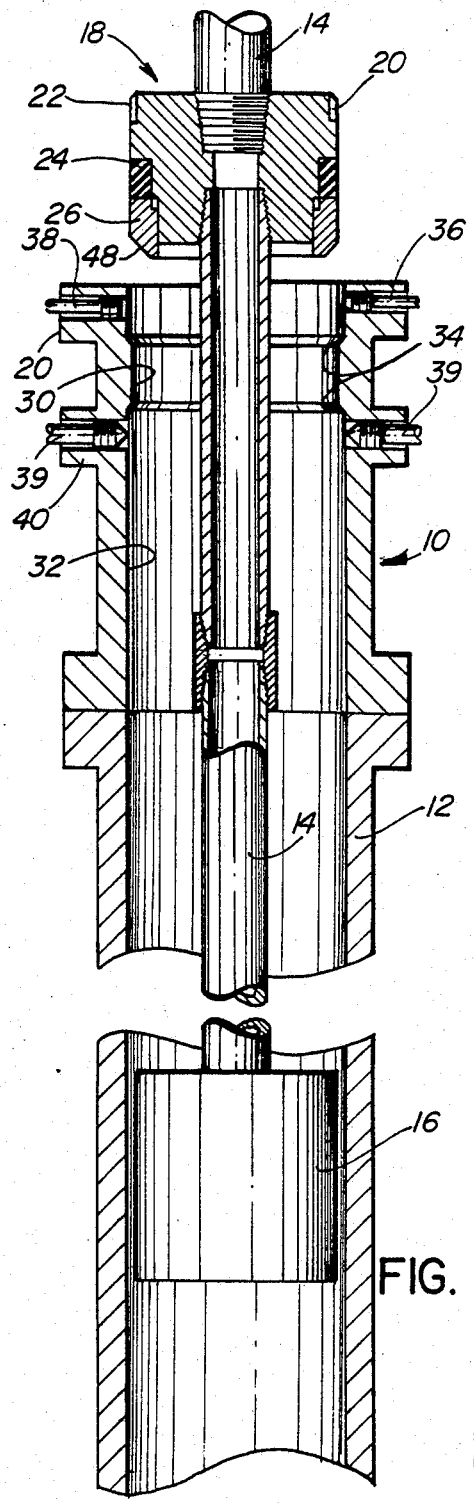
FIG. 1 is a vertical sectional view of the tubing spool and tubing hanger after the installation of the tubing hanger on the tubing.

Referring initially to FIG. 1, a tubing spool-tubing hanger arrangement includes a tubing spool illustrated generally at 10 which is adapted for connection to the upper end of a well casing 12, a sub 14 having a packing element 16 on the lower end thereof includes, above the packing element, a tubing hanger 18. This assembly is lowered through the tubing spool 10 so that the packing element enters the area of the casing that is desired to be packed off and the tubing hanger is adapted to seal off the upper end of the spool.

Figure 8:
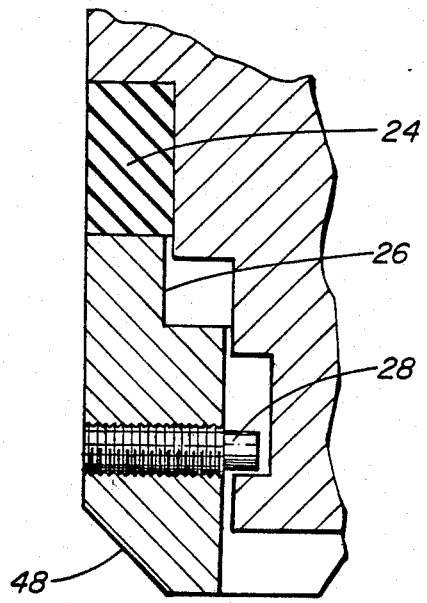
FIG. 8 is an enlarged, fragmentary sectional view of a portion of the tubing hanger.
Figure 9:
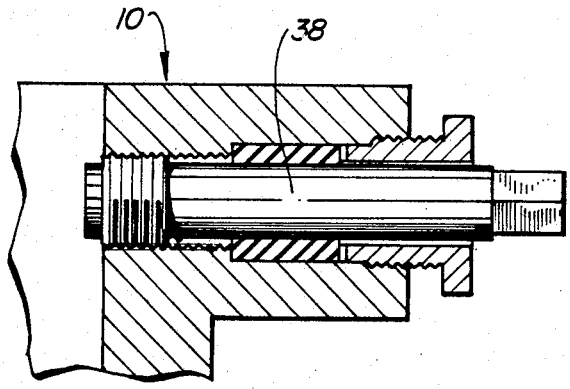
FIGS. 9 and 10 are cross-sectional views of the locking/locating pin and dog pin respectively.
Figure 10:
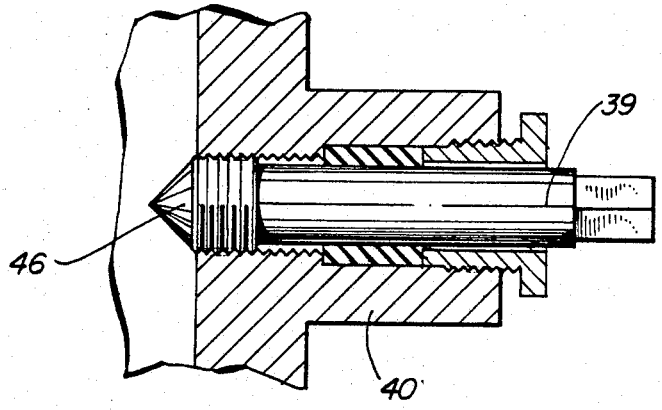

The tubing hanger 18 is of substantial thickness and is circular or cylindrical in configuration and is provided with at least one locating slot 20 on its upper periphery as well as a plurality of sockets or locking holes 22. Usually three or more of the locking sockets are provided and spaced evenly around the periphery of the tubing hanger. A flexible, ring shaped packing element 24 is provided roughly centrally of the tubing hanger around the circumference thereof and, while the packing ring 24 is illustrated as a unitary element, it can be made up of separate rings or the like. This packing element 24 is held in place on the tubing hanger 18 by an energizing ring 26 by means of lock screws 28 as shown more clearly in FIG. 8. Preferably, three or more lock screws 28 are spaced above the periphery of the energizing ring.

The tubing spool 10 is of a standard size, dictated by well requirements and industry standards. Spool 10 has an inside diameter such that the tubing hanger 18 and its associated elements will slide through the packing area 30 of the spool and will be a non-engaging fit in the space 32 there below. The packing area 30 includes bevelled shoulders 34 which serve to guide the tubing hanger to the center of the spool when it is moved through the packing area.

One or more locating pins 36 and locking pins 38 are located on the periphery of the upper end of the spool 10 and they match and cooperate with slot 20 and locking sockets 22 respectively provided for them on the tubing hanger 18. Dogpins 39 are located on a flange 40 of the spool.

Figure 2:
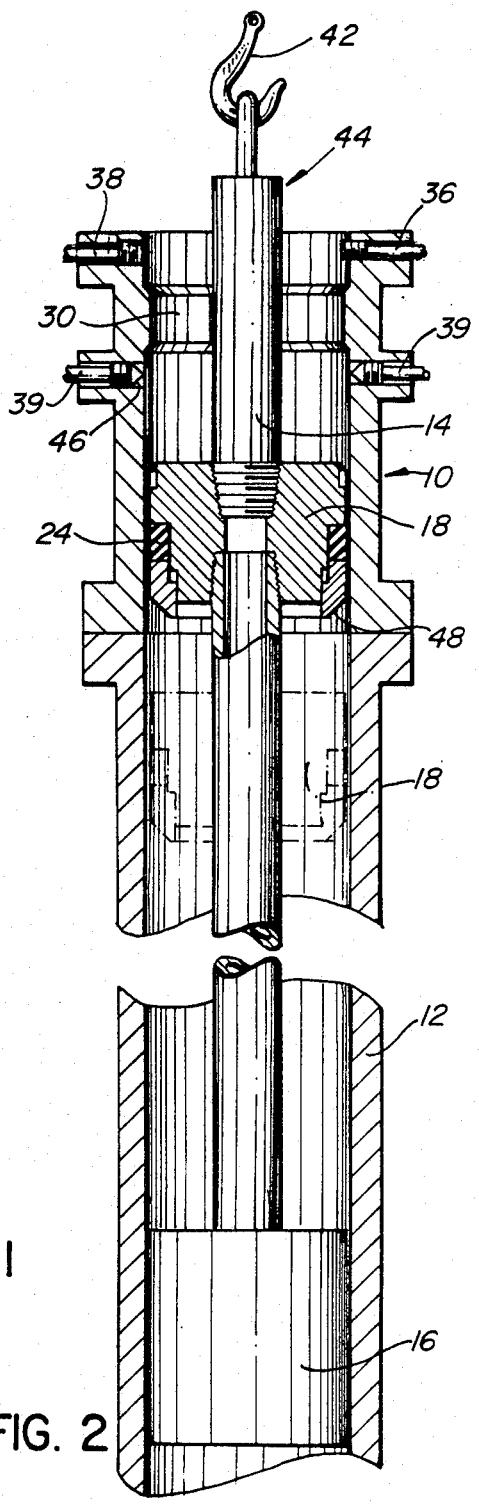
FIG. 2 is a vertical sectional view of the tubing spool and tubing hanger with the latter in the low position after the packer has been set in place.

During installation, the locating pins 36, locking pins 38 and dogpins 39 are all backed off to their outermost positions so that they will not interfere with the free movement of the tubing hanger 18 through the spool 10 as seen in FIG. 1. The tubing hanger 18 is installed on tubing 14 in a conventional manner and is lowered through the spool 10 on the sub by means of a hook 42 which is suspended by outside means, as shown in FIG. 2. The packer 16 is then latched and packed off in the well casing 12 in the conventional manner. The tubing hanger 18 is now in the position shown in FIG. 2 and, depending on the length of stretch required for the proper tensioning of the tubing 14, the tubing hanger 18 may even be in a position shown by the phantom line in FIG. 2.

Figure 3:
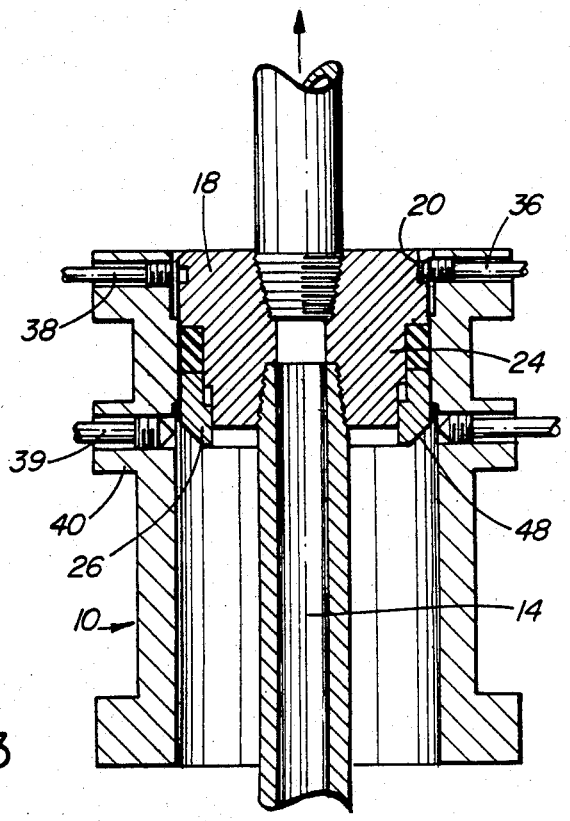
FIG. 3 is a vertical sectional view of a tubing spool and tubing hanger when the tubing is being stretched.
Figure 4:
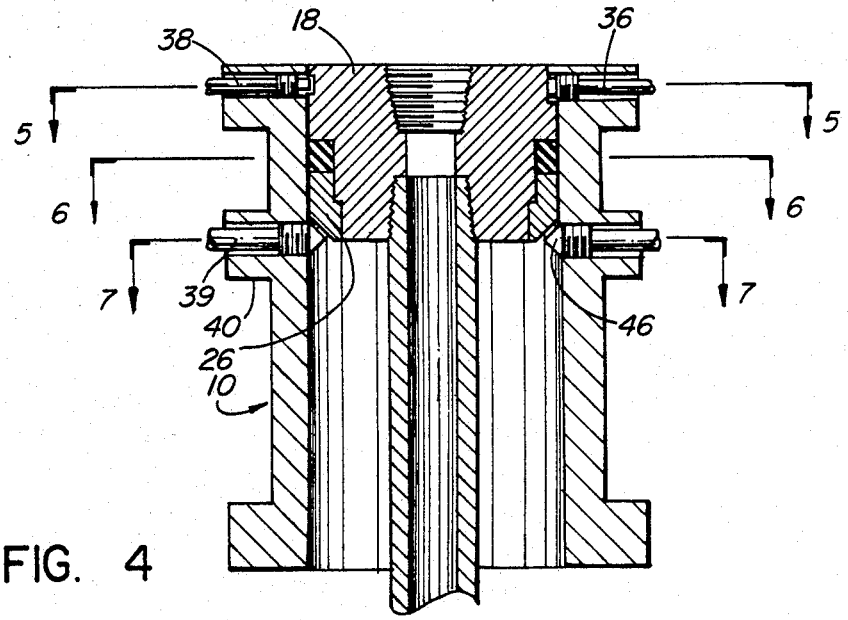
FIG. 4 is a vertical sectional view of the tubing spool and tubing hanger after the tubing hanger has been locked in place and the spaces above and below it sealed.

The locating pin 36 is then turned into the engaging position as shown at the upper end of FIG. 2 and the tubing hanger 18 and tubing string is now pulled upwardly by the sub 44 and hook 42. With the packer 16 latched in place, the tubing is upwardly stretched until the slot 20 in the tubing hanger engages the locating pin 36 and the tubing hanger terminates in the position shown in FIG. 3. The slot 20 in the tubing hanger is used for locating the tubing hanger in the spool 10 if the hole in the center of the tubing hanger is off-center or if more than one tubing string is in the tubing hanger.

Figure 5:
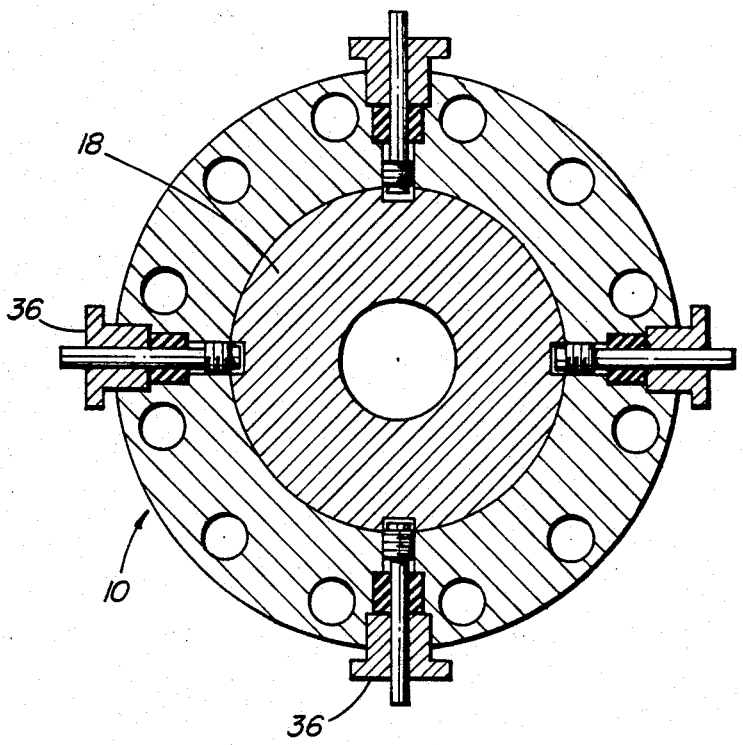
FIGS. 5, 6 and 7 are cross-sectional views taken along lines 5—5, 6—6 and 7—7, respectively, of FIG. 4.
Figure 6:
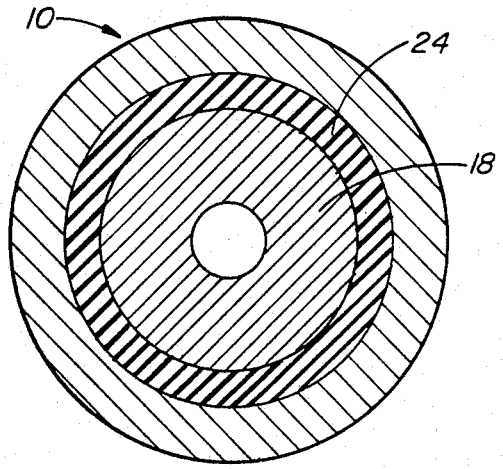
Figure 7:
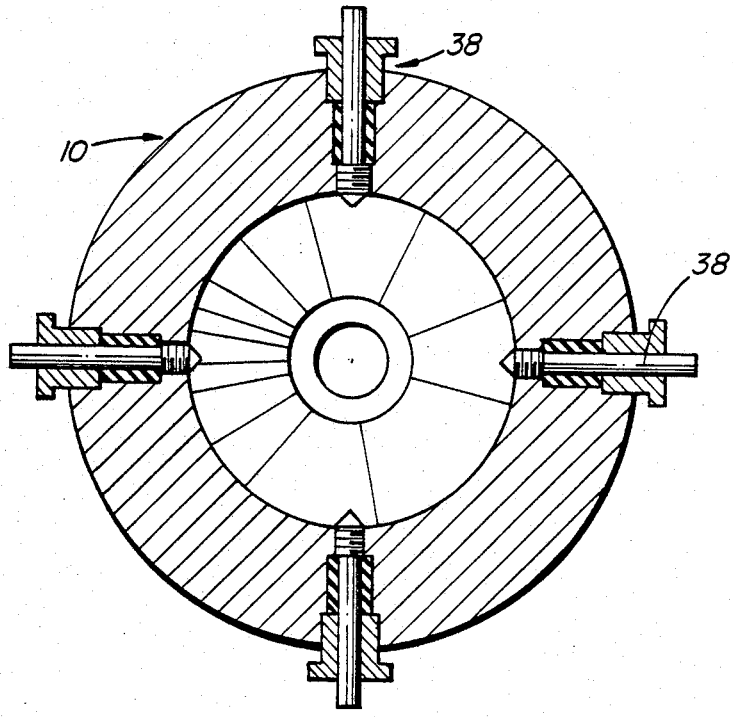

The locking pins 38 are now turned inwardly to engage the locking sockets 22 in the tubing hanger, as shown in cross-section in FIG. 5, and the tubing hanger 18 is now locked in place in the spool 10. Subsequently, the dogpins 39 which have conical inner ends 46, are turned inwardly so that the conical inner ends 46 engage the bevelled periphery 48 of the energizing ring 26 thereby forcing the ring upwardly, the upward movement of the ring 26 compressing the packing ring 24 so that it tightly engages the walls 30 in the upper end of the spool 10, thereby sealing the space below and above the tubing hanger 18. The tubing spool 10 is now setup to accept any of the usual equipment that is required by the end user.

Figure 11:
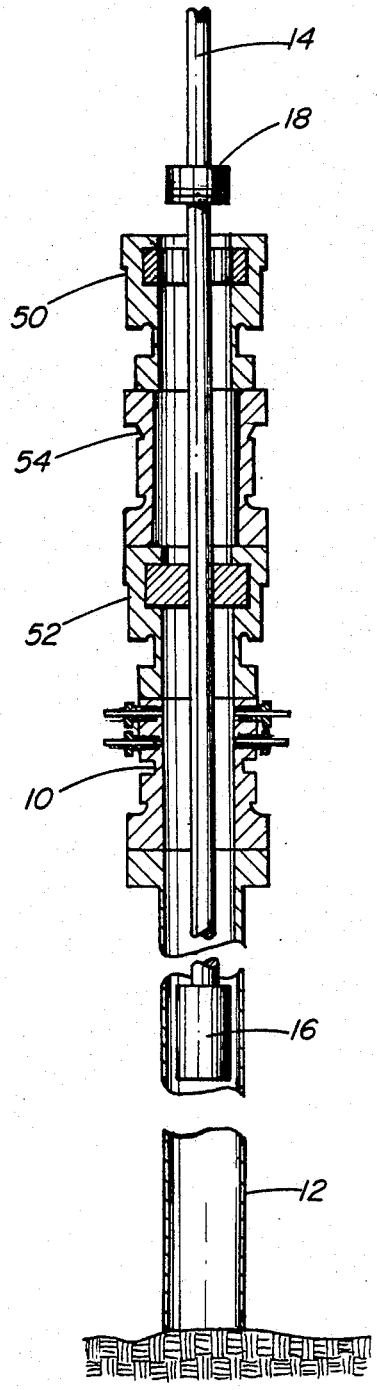
FIGS. 11, 12 and 13 are schematic sectional views showing the use of the present invention in a well under pressure.
Figure 12:
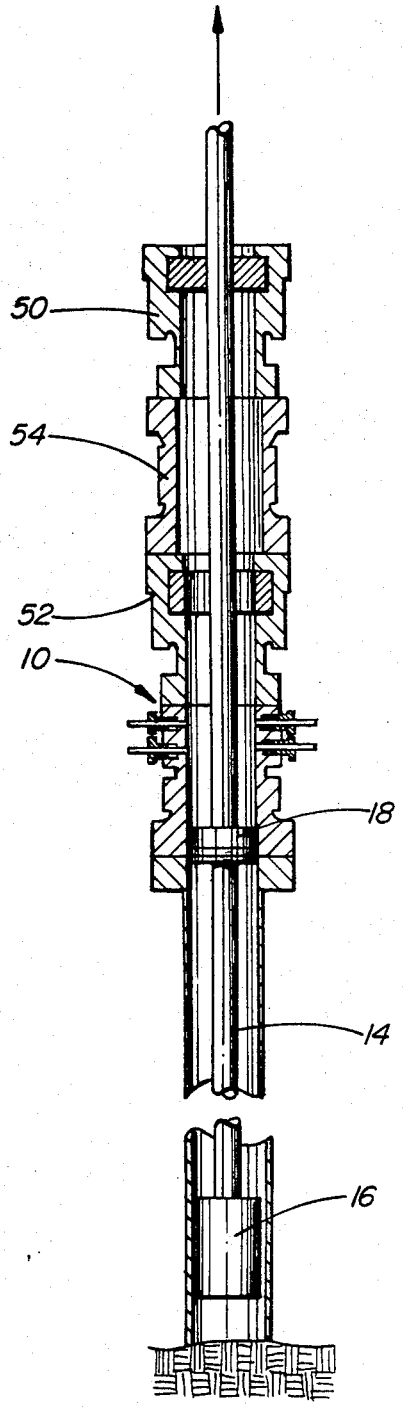
Figure 13:
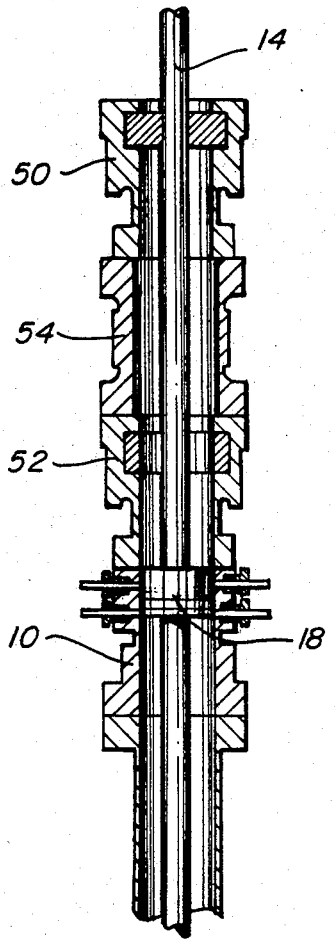

Advantages of the present invention when used in a pressurized well, will be appreciated from a review of FIGS. 11, 12 and 13.

FIG. 11 shows the tubing hanger 18 being run on the last joint of the tubing 14. An upper blow-out preventer 50 and a lower blow-out preventer 52, with an intermediate spool 54, are mounted on top of the tubing spool 10. The upper blow-out preventer 50 is opened and the bottom blow-out preventer 52 is closed.

In FIG. 12, the tubing hanger has been lowered through the upper blow-out preventer which is now closed and the lower blow-out preventer 52 being opened so that the tubing hanger 18 travels down through the spool 10. The packer 16 is then latched and packed off and the sub is now pulled upwardly to set the tension in the tubing and the tubing hanger 18 is seated, locked in place and sealed as shown in FIG. 13. The blow-out preventer equipment can now be safely taken off and the required equipment put on the well head. It will be noted that the stretched length of the tubing 14 can be set exactly as required due to the fact that the tubing hanger 18 is put in place in tubing 14 and the packer 16 latched in place in the well before the tensioning of the tubing takes place. The length of tubing in the BOP stack is not a factor in the final tubing length.

Those skilled in the art will appreciate the various features, characteristics and advantages of the present invention have been set forth herein or are readily realizable from the detailed description of the illustrated embodiment. However, the disclosure is illustrative and various changes may be made while utilizing the principles of the present invention in falling within the scope of the invention as expressed in the appended claims.

I claim:

1. A combined tubing spool and tubing hanger assembly for use in servicing oil and gas wells, said assembly comprising:

a tubing spool for connection to the upper end of a well casing, said spool including an internal annular portion of reduced diameter with respect to the remainder of the internal surface of said spool and sized to allow said tubing hanger to pass therethrough;

means for locating said tubing hanger in said reduced diameter portion of said spool;

means for releasably securing said tubing hanger in said spool, comprising a plurality of circumferentially spaced recesses in the side wall of said hanger and a corresponding plurality of locking pins positioned in the wall of said spool above said reduced diameter portion of said tubing spool and being engageable with said recesses to prevent movement of said hanger in said spool;

an annular, resilient packing element on said hanger and adapted to engage and seal against said annular portion of reduced diameter in said spool;

means on said hanger for expanding said resilient packing element into sealing engagement with said spool; and means located in the wall of said spool for actuating said expanding means;

said actuating means comprising a plurality of dogpins having conical inner ends, said dogpins being circumferentially spaced about the wall of said spool positioned below said reduced diameter portion thereof and directed radially inwardly thereof;

said hanger locating means, releasable securing means and expander actuating means being operable from outside of said tubing and hanger assembly.

2. An assembly according to claim 1 wherein the means for locating said tubing hanger in said reduced diameter comprises at least one slot formed in the upper peripheral edge of said hanger and a locating pin positioned in the wall of said spool and moveable radially inwardly thereof so as to be received in said hanger slot.

3. An assembly according to claim 2 wherein said means for expanding the resilient packing element further comprises an axially moveable annular ring concentrically mounted on the lower end of said hanger and in contact with said resilient element, a bevelled lower peripheral edge on said annular ring; the conical inner ends of said dogpins engaging the bevelled periphery of said ring to axially move said ring thereby causing said resilient element to expand into sealing with the annular portion of reduced diameter of said spool.

* * * * *